US009527568B1

(12) United States Patent
Belter et al.

(10) Patent No.: US 9,527,568 B1
(45) Date of Patent: Dec. 27, 2016

(54) STERN DRIVES HAVING ACCESSIBLE COOLING WATER SEA PUMP

(71) Applicant: Brunswick Corporation, Lake Forest, IL (US)

(72) Inventors: David J. Belter, Oshkosh, WI (US); Ryan E. Mueller, Ripon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/879,261

(22) Filed: Oct. 9, 2015

(51) Int. Cl.

| | |
|---|---|
| ***F02N 1/00*** | (2006.01) |
| ***B63H 21/38*** | (2006.01) |
| ***F02B 61/04*** | (2006.01) |
| ***F01P 3/20*** | (2006.01) |
| ***F01P 5/12*** | (2006.01) |
| ***B63H 21/36*** | (2006.01) |
| ***B63H 21/32*** | (2006.01) |

(52) U.S. Cl.
CPC ..... *B63H 21/383* (2013.01); *B63H 21/32* (2013.01); *B63H 21/36* (2013.01); *F01P 3/20* (2013.01); *F01P 5/12* (2013.01); *F02B 61/04* (2013.01)

(58) Field of Classification Search
CPC ..... B63H 21/38; B63H 21/383; F01P 3/20; F01P 5/12; F02B 61/04
USPC ..... 440/88 P; 123/41.47
See application file for complete search history.

(56) References Cited

U.S. PATENT DOCUMENTS

| | | | | |
|---|---|---|---|---|
| 4,565,534 | A * | 1/1986 | Bland | F02B 61/04 123/41.47 |
| 4,764,135 | A | 8/1988 | McCormick | |
| 6,571,753 | B1 | 6/2003 | Jaeger | |
| 6,651,598 | B2 * | 11/2003 | Kim | B60H 1/00314 123/41.47 |
| 6,808,432 | B1 | 10/2004 | Davis et al. | |
| 7,476,135 | B2 | 1/2009 | Caldwell et al. | |
| 7,585,196 | B1 | 9/2009 | Jaeger | |

* cited by examiner

*Primary Examiner* — Daniel V Venne
(74) *Attorney, Agent, or Firm* — Andrus Intellectual Property Law, LLP

(57) ABSTRACT

A stern drive for a marine vessel comprises an internal combustion engine that extends in a longitudinal direction, a horizontal direction that is perpendicular to the longitudinal direction, and a vertical direction that is perpendicular to the longitudinal direction and perpendicular to the horizontal direction. An engine output shaft extends in the longitudinal direction and is driven to rotate by the internal combustion engine. A cooling water sea pump is powered by rotation of the engine output shaft to pump cooling water to the internal combustion engine. The cooling water sea pump comprises a first pump input shaft that extends parallel to the engine output shaft, a second pump input shaft that extends transversely to the first pump input shaft and is driven to rotate by the first pump input shaft, and an impeller that is driven to rotate by the second pump input shaft to pump the cooling water to the internal combustion engine.

20 Claims, 6 Drawing Sheets

STERN DRIVES HAVING ACCESSIBLE COOLING WATER SEA PUMP

FIELD

The present disclosure relates to stern drives for marine vessels and more particularly to cooling water sea pumps for cooling the internal combustion engine of a stern drive.

BACKGROUND

The following U.S. Patents are hereby incorporated herein by reference in entirety.

U.S. Pat. No. 7,585,196 discloses a cooling system for a marine propulsion device that provides a transom opening that is sufficiently low with respect to other components of the marine propulsion device to allow automatic draining of all cooling water from the system when the marine vessel is removed from the body of water in which it had been operating. The engine cooling passages and other conduits and passages of the cooling system are all located at positions above the transom opening. The system provides automatic draining for a marine cooling system that is an open system and which contains no closed cooling portions.

U.S. Pat. No. 7,476,135 discloses a cooling system for a marine vessel that is configured to allow all cooling water to flow out of the cooling circuit naturally and under the influence of gravity when the marine vessel is removed from the body of water. All conduits of the cooling circuit are sloped downwardly and rearwardly from within the marine vessel to an opening through its transom. Traps are avoided so that residual water is not retained within locations of the cooling system after the natural draining process is complete. The opening through the transom of the marine vessel is at or below all conduits of the cooling system in order to facilitate the natural draining of the cooling system under the influence of gravity and without the need for operator intervention.

U.S. Pat. No. 6,808,432 discloses a cooling system for an out drive of a stern drive device that draws water from a body of water in which a marine vessel is operated and conducts the water through a conduit to an outlet end that is configured to direct a stream of water into a space which is defined under a removably attachable cover and above a surface of a heat producing portion of the out drive. The cover contains a turbulently flowing stream of water in the space in order to more efficiently conduct the water in thermal communication with the outer surface of the heat producing portion. Return passages are provided between the cover and the surface of the out drive to allow water to return, under the influence of gravity, back to the body of water from which it was drawn.

U.S. Pat. No. 6,571,753 discloses an engine coolant draining system that is provided with a vent module that is shaped to be inserted into the coolant conduit of a marine engine. The vent module comprises an umbrella-shaped valve which operates as an unidirectional valve to allow air to flow into the coolant conduit from the region external to the coolant conduit, but prevents liquid from flowing out of the coolant conduit through the vent module when the pressure within the coolant conduit is greater than atmospheric pressure external to the vent module.

U.S. Pat. No. 4,764,135 discloses a marine stern drive unit in which oil is circulated upwardly from the propeller housing and through the drive shaft sleeve to the upper gear case. A return oil line connects from the upper gear case and downwardly through the lower gear case to the propeller housing. The return line is disposed within a cooling water chamber communicating with the drive engine to create an intercooling or heat exchanging effect whereby the incoming water from a lake cools the recirculating stern drive unit lubricant. A combination of threaded drive shaft and internally grooved sleeve is utilized to pump the oil through the system.

SUMMARY

This Summary is provided herein to introduce a selection concepts that are further described herein below in the Detailed Description. This Summary is not intended to identify key or essential features from the claimed subject matter, nor is it intended to be used as an aid in limiting the scope of the claimed subject matter.

In certain examples, a stern drive for a marine vessel comprises an internal combustion engine that extends in a longitudinal direction, a horizontal direction that is perpendicular to the longitudinal direction, and a vertical direction that is perpendicular to the longitudinal direction and perpendicular to the horizontal direction. An engine output shaft extends in the longitudinal direction and is driven to rotate by the internal combustion engine. A cooling water sea pump is powered by rotation of the engine output shaft to pump cooling water to the internal combustion engine. The cooling water sea pump comprises a first pump input shaft that extends parallel to the engine output shaft, a second pump input shaft that extends transversely to the first pump input shaft and is driven to rotate by the first pump input shaft, and an impeller that is driven to rotate by the second pump input shaft to pump the cooling water to the internal combustion engine.

BRIEF DESCRIPTION OF THE DRAWINGS

Examples are described with reference to the following drawing FIGURES. Like reference numbers are used throughout the FIGURES to reference like features and components.

DETAILED DESCRIPTION OF THE DRAWINGS

Figure 1:
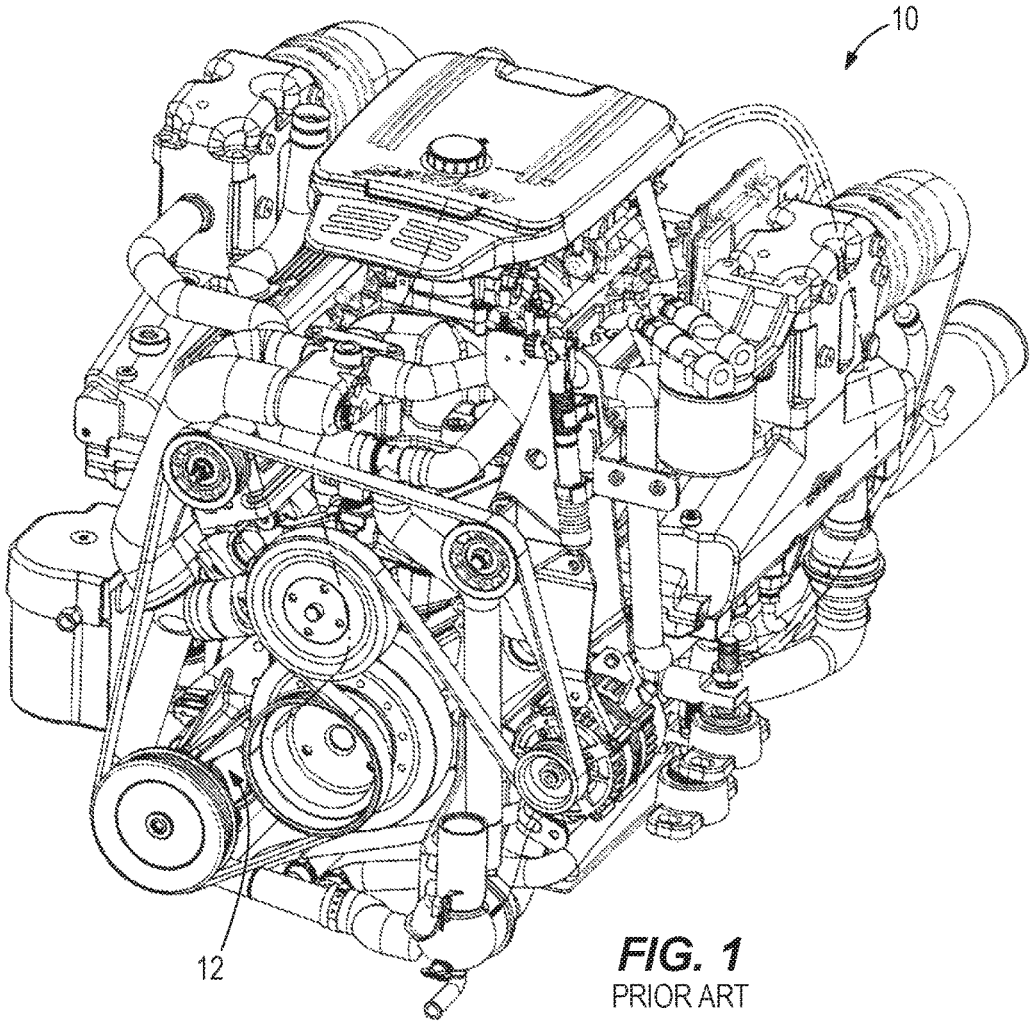
FIG. 1 PRIOR ART
FIG. 1 is a perspective view of a prior art internal combustion engine for a stern drive on a marine vessel.

FIG. 1 is taken from U.S. Pat. No. 6,571,753 and depicts a prior art internal combustion engine 10 for use in a stern drive of a marine vessel. The internal combustion engine 10 has a cooling water sea pump (shown at Arrow 12) located towards a front lower side of the engine 10 and configured to pump sea water to the internal combustion engine 10 for cooling purposes. Through use and experimentation, the present inventors have determined that the prior art cooling water sea pump 12 is difficult to service and/or replace. The pump 12 is located down low at the front of the engine 10 below an exhaust conduit and other engine structures. Usually there is an engine compartment including vertical walls and/or for example a seat of the marine vessel located very close to the front of the engine 10, which does not leave enough space for access to the pump 12 for maintenance, replacement, and/or the like. The pump 12 is not easily accessed in the vertical direction. In some marine vessels, the inventors have found it necessary to remove the backseat in order to maintain the pump 12. This is inconvenient and time consuming.

Figure 2:
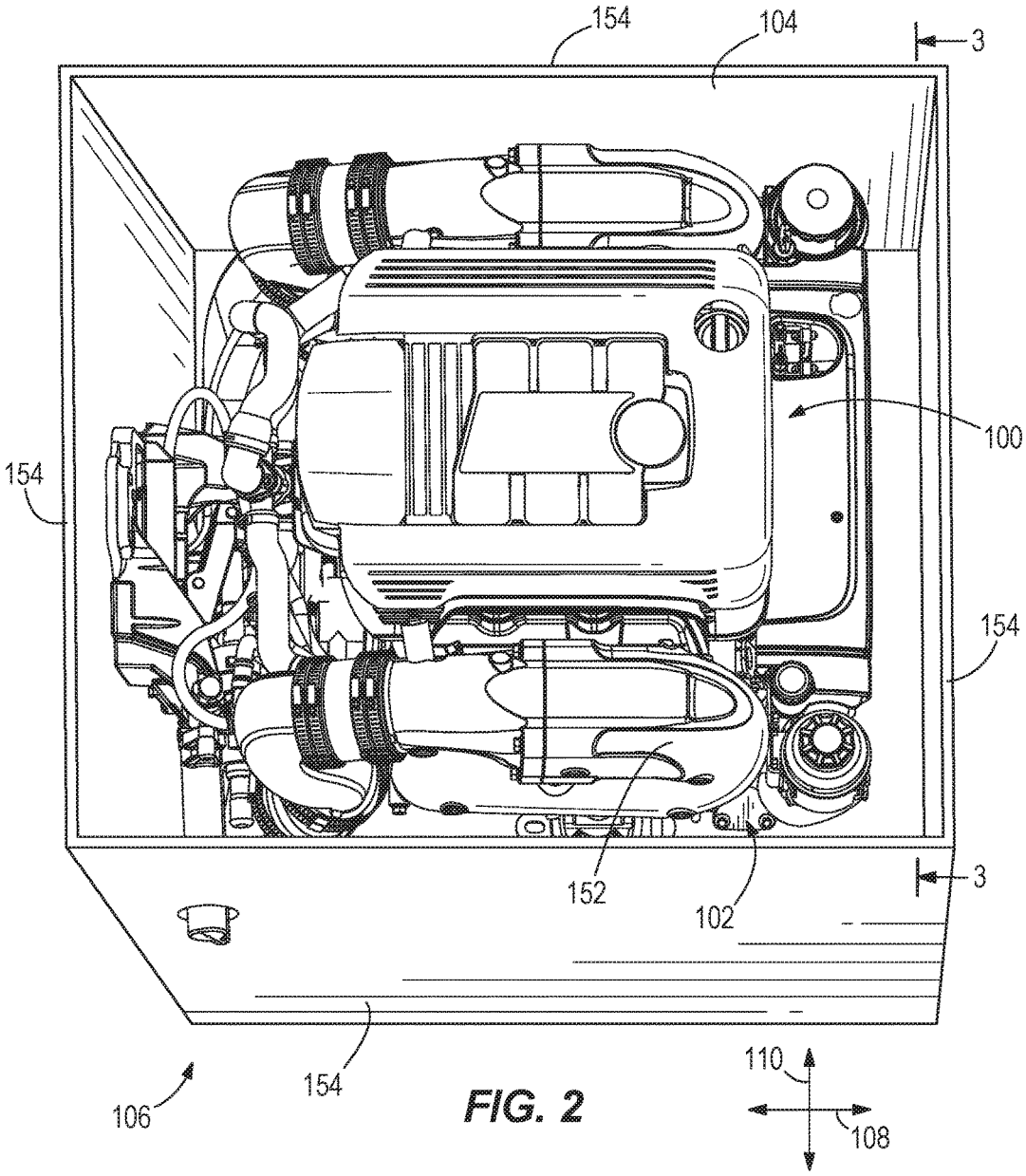
FIG. 2 is a top perspective view of an internal combustion engine for a stern drive according to the present disclosure, wherein the internal combustion engine is disposed in an engine compartment.
Figure 3:
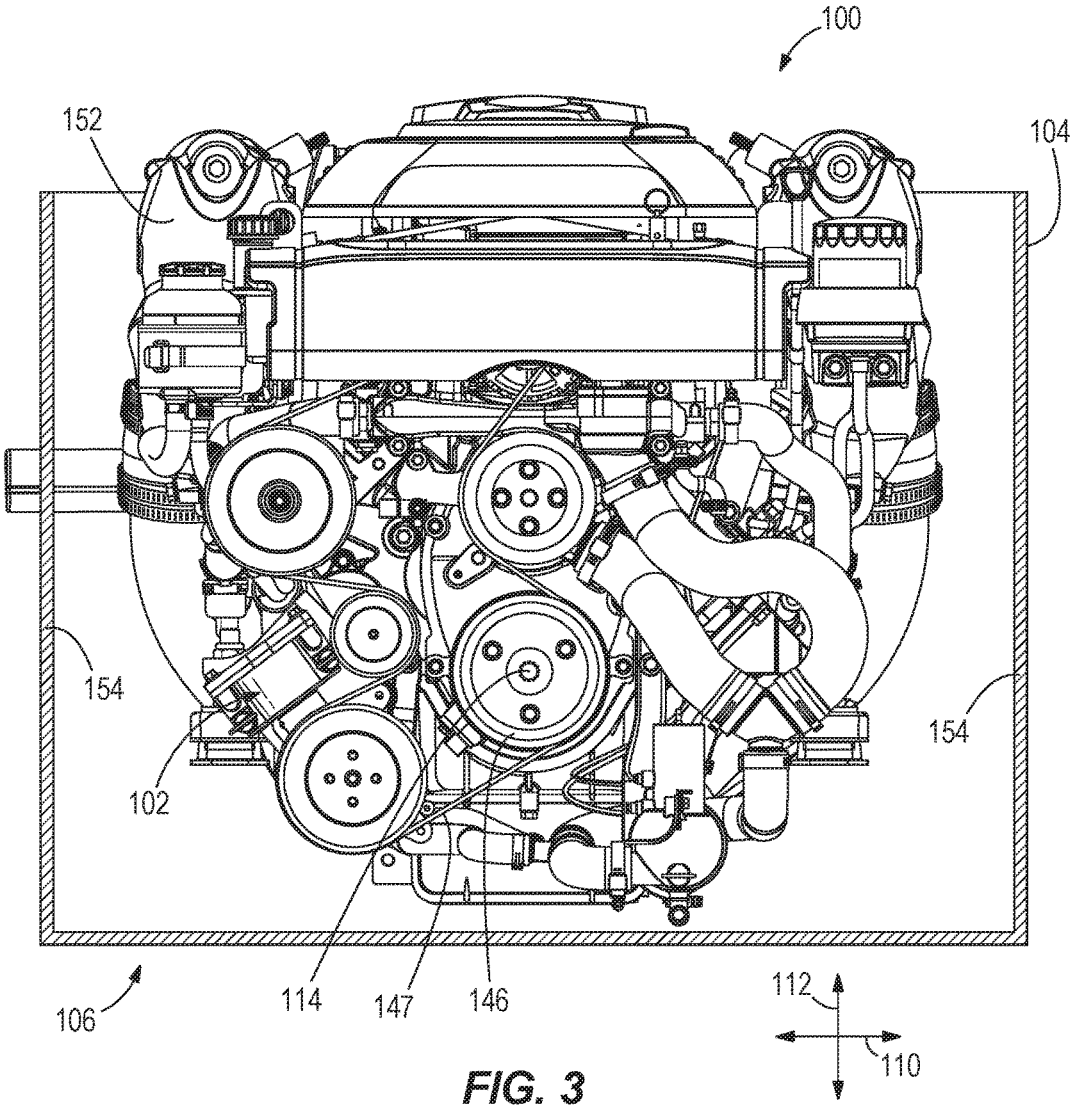
FIG. 3 is a view of Section 3-3, taken in FIG. 2.

FIGS. 2 and 3 depict an internal combustion engine 100 having a cooling water sea pump 102 configured according to the present disclosure. The internal combustion engine 100 is disposed in an engine compartment 104 in a stern drive 106 arrangement. The internal combustion engine 100 extends in a longitudinal direction 108, a horizontal direction 110 that is perpendicular to the longitudinal direction 108 and a vertical direction 112 that is perpendicular to the longitudinal direction 108 and perpendicular to the horizontal direction 110. As is conventional, an engine output shaft 114 (drive shaft) extends in the longitudinal direction 108 and is driven to rotate by the combustion process of the internal combustion engine 100.

The cooling water sea pump 102 is powered by rotation of the engine output shaft 114 to thereby pump cooling water to the internal combustion engine 100, as will be described further herein below. The cooling water sea pump 102 is spaced apart from the engine output shaft 114 and is affixed to the internal combustion engine 100 in the same location as the cooling water sea pump 12 shown in prior art FIG. 1. As explained further herein below, the cooling water sea pump 102 is configured so that it is easily accessed in the vertical direction 112 for maintenance and/or replacement.

Figure 4:
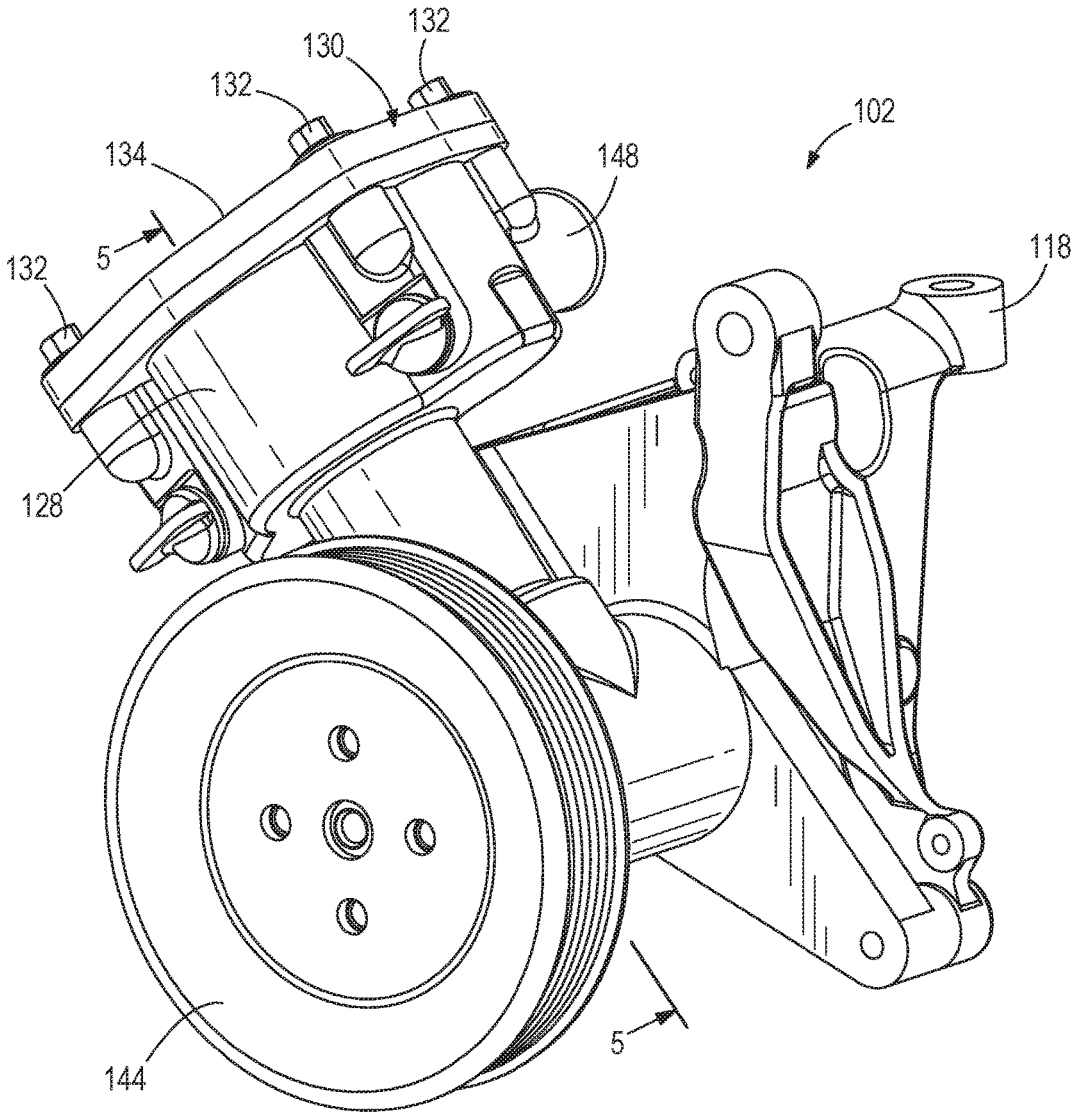
FIG. 4 is a perspective view of a cooling water sea pump for the stern drive shown in FIGS. 2 and 3.
Figure 5:
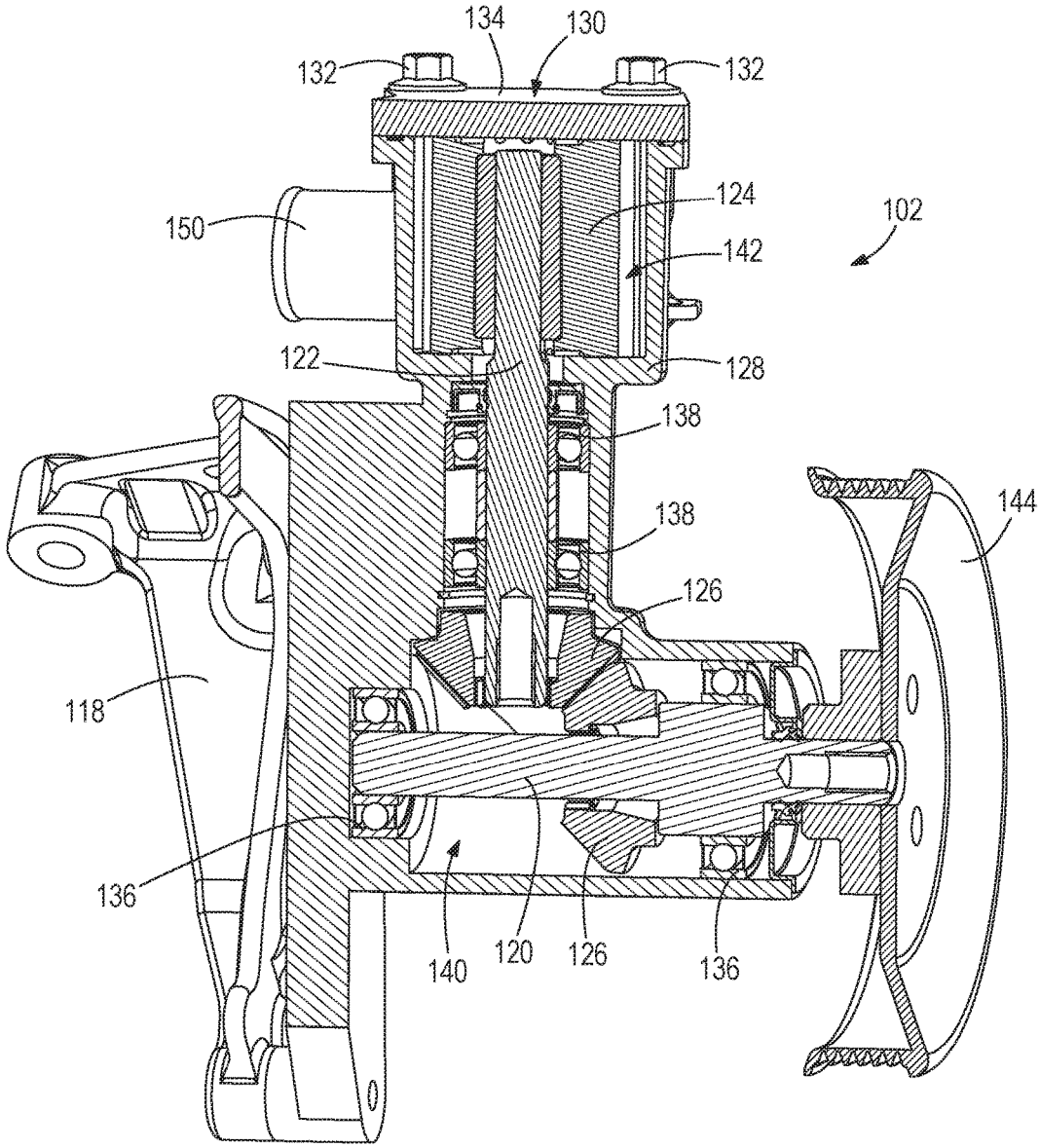
FIG. 5 is a view of Section 5-5, taken in FIG. 4.
Figure 6:
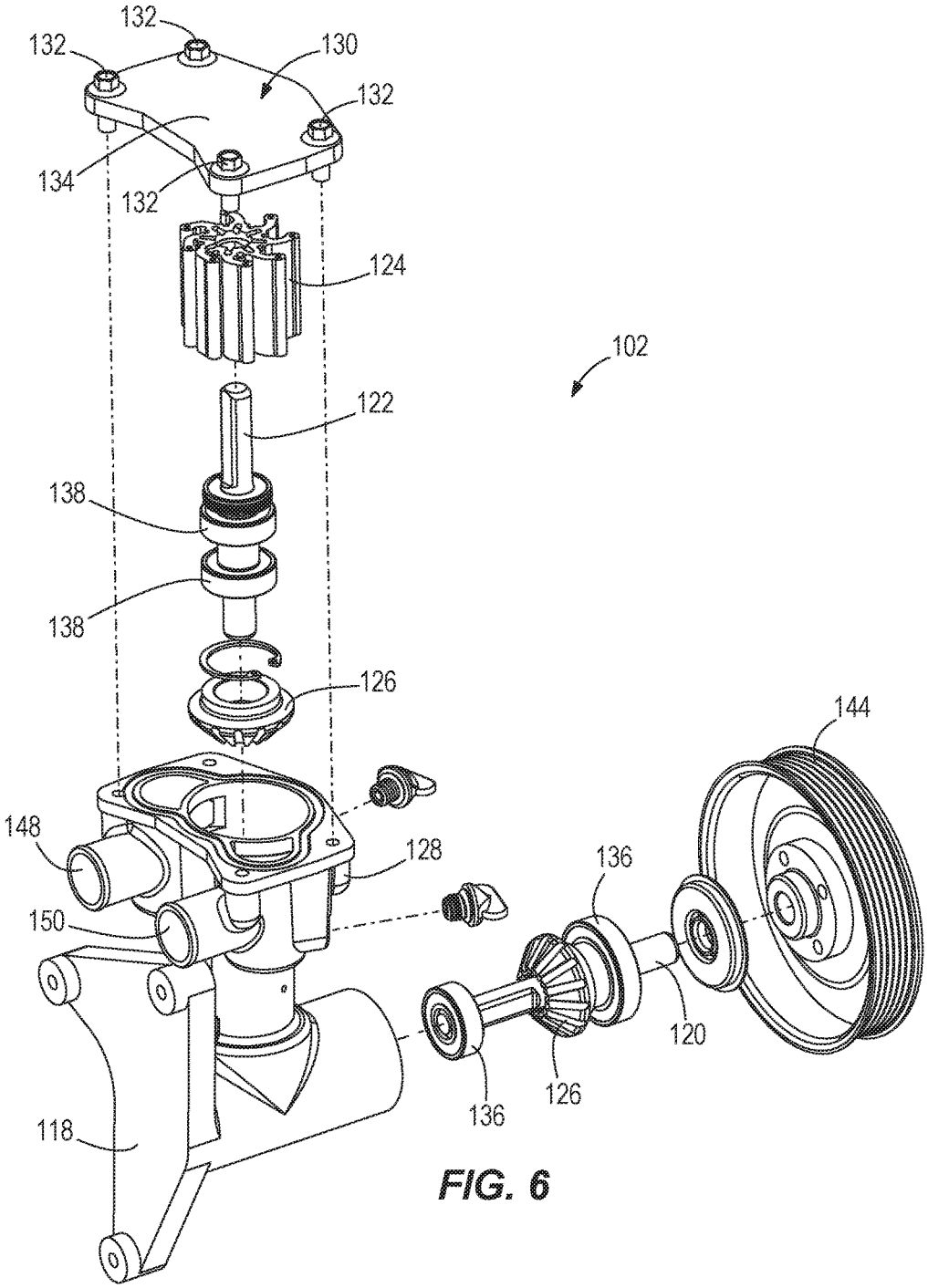
FIG. 6 is an exploded view of the cooling water sea pump.

FIGS. 4-6 depict the cooling water sea pump 102 and a bracket 118 that affixes the cooling water sea pump 102 to the internal combustion engine 100. The cooling water sea pump 102 has a first pump shaft 120 that extends parallel to the engine output shaft 114 and a second pump input shaft 122 that extends transversely to the first pump input shaft 120 and is driven to rotate by the first pump input shaft 120. An impeller 124 is driven to rotate by the second pump input shaft 122 to thereby pump the noted cooling water to the internal combustion engine 100. In this example, the first pump input shaft 120 and second pump input shaft 122 are perpendicular to each other. Bevel gears 126 connects the first pump input shaft 120 to the second pump input shaft 122 such that rotation of the first pump input shaft 120 causes rotation of the second pump input shaft 122.

A pump housing 128 houses the first pump input shaft 120, second pump input shaft 122, and impeller 124. An access door 130 is disposed on the pump housing 128 and is oriented so that it is accessible in the vertical direction 112. The access door 130 is removably attached to the pump housing 128 by a plurality of removable fasteners 132. The removable fasteners extend transversely to the horizontal direction 110 and transversely to the longitudinal direction 108. In this example, the access door 130 is a plate 134 that faces upwardly in the vertical direction 112 and outwardly, away from the internal combustion engine 100, in the horizontal direction 110.

Referring to FIGS. 5 and 6, bearings 136, 138 support the first pump input shaft 120 and the second pump input shaft 122 with respect to the pump housing 128, so that the first pump input shaft 120 and second pump input shaft 122 are both rotatable with respect to the pump housing 128. The pump housing 128 has a lower chamber 140 that houses the first pump input shaft 120 and an upper chamber 142 that houses the impeller 124. First and second bearings 136 support opposite end portions of the first pump input shaft 120 with respect to the pump housing 128 so that the first pump input shaft 120 is rotatable with respect to the pump housing 128. Third and fourth bearings 138 support opposite end portions of the second input shaft 122 with respect to the pump housing 128 so that the second pump input shaft 122 is rotatable with respect to the pump housing 128.

A pulley 144 is disposed on the first pump input shaft 120. The pulley 144 is connected to a pulley 146 on the engine output shaft 114 by a belt 147 such that rotation of the engine output shaft 114 causes rotation of the pulley 144, which causes rotation of the first pump input shaft 120, which causes rotation of the second pump input shaft 122, which causes rotation of the impeller 124.

The cooling water sea pump 102 has an inlet 148 that receives the cooling water from the body of water in which the associated marine vessel is operating and an outlet 150 that discharges the cooling water to the internal combustion engine 100. The inlet 148 and outlet 150 both extend parallel to the first pump input shaft 120.

The stern drive 106 is disposed in the engine compartment 104 of the marine vessel and adjacent vessel surfaces 154. It is advantageous to keep the cooling water sea pump 102 low in the engine compartment 104 so it stays as close to the external water line on the marine vessel as possible. This makes the cooling water sea pump 102 easier to prime. Advantageously, even though the cooling water sea pump 102 is located below an exhaust manifold 152 of the internal combustion engine 100 in the vertical direction 112, and below numerous other engine components, it is still accessible for maintenance and/or replacement via the access door 130 and removable fasteners 132. The configuration of the cooling water sea pump 102 conveniently allows access to the access door 130 in the vertical direction, despite its location beneath the exhaust manifold 152 and adjacent the noted vessel surface 154.

In the present disclosure, certain terms have been used for brevity, clearness and understanding. No unnecessary limitations are to be implied therefrom beyond the requirement of the prior art because such terms are used for descriptive purposes only and are intended to be broadly construed. The different devices and methods described herein may be used alone or in combination with other devices and methods. Various equivalents, alternatives and modifications are possible within the scope of the appended claims.

What is claimed is:

1. A stern drive arrangement for a marine vessel, the stern drive arrangement comprising:

an internal combustion engine that extends in a longitudinal direction, a horizontal direction that is perpendicular to the longitudinal direction, and a vertical direction that is perpendicular to the longitudinal direction and perpendicular to the horizontal direction;

an engine output shaft that extends in the longitudinal direction and is driven to rotate by the internal combustion engine; and a cooling water sea pump that is powered by rotation of the engine output shaft to pump cooling water to the internal combustion engine, wherein the cooling water sea pump comprises a first pump input shaft that extends parallel to the engine output shaft;

a second pump input shaft that extends transversely to the first pump input shaft and is driven to rotate by the first pump input shaft; and an impeller that is driven to rotate by the second pump input shaft to pump the cooling water to the internal combustion engine.

2. The stern drive arrangement according to claim 1, wherein the cooling water sea pump is spaced apart from the engine output shaft.

3. The stern drive arrangement according to claim 2, wherein the cooling water sea pump is affixed to the internal combustion engine.

4. The stern drive arrangement according to claim 3, further comprising a bracket that affixes the cooling water sea pump to the internal combustion engine.

5. The stern drive arrangement according to claim 1, wherein the first pump input shaft and second pump input shaft are perpendicular to each other.

6. The stern drive arrangement according to claim 5, further comprising a bevel gear that connects the first pump input shaft to the second pump input shaft.

7. The stern drive arrangement according to claim 1, wherein the cooling water sea pump further comprises a pump housing that houses the first pump input shaft, second pump input shaft, and impeller.

8. The stern drive arrangement according to claim 7, further comprising an access door on the pump housing, wherein the access door is accessible in the vertical direction.

9. The stern drive arrangement according to claim 8, wherein the access door is removably attached to the pump housing by a plurality of removable fasteners.

10. The stern drive arrangement according to claim 9, wherein the plurality of removable fasteners extends transversely to the horizontal direction and transversely to the longitudinal direction.

11. The stern drive arrangement according to claim 8, wherein the access door comprises a plate that faces upwardly in the vertical direction and outwardly away from the internal combustion engine in the horizontal direction.

12. The stern drive arrangement according to claim 7, further comprising bearings that support the first pump input shaft and the second pump input shaft with respect to the pump housing so that the first pump input shaft and second pump input shaft are both rotatable with respect to the pump housing.

13. The stern drive arrangement according to claim 7, wherein the pump housing comprises a lower chamber that houses the first pump input shaft and an upper chamber that houses the impeller.

14. The stern drive arrangement according to claim 13, further comprising first and second bearings that support opposite end portions of the first pump input shaft with respect to the pump housing so that the first pump input shaft is rotatable with respect to the pump housing and further comprising third and fourth bearings that support opposite end portions of the second pump input shaft with respect to the pump housing so that the second pump input shaft is rotatable with respect to the pump housing.

15. The stern drive arrangement according to claim 1, further comprising a pulley on the first pump input shaft, wherein the pulley is connected to the engine output shaft such that rotation of the engine output shaft causes rotation of the pulley, which causes rotation of the first pump input shaft, which causes rotation of the second pump input shaft, which causes rotation of the impeller.

16. The stern drive arrangement according to claim 1, further comprising an exhaust manifold and wherein the cooling water sea pump is located below the exhaust manifold in the vertical direction.

17. The stern drive arrangement according to claim 1, wherein the cooling water sea pump further comprises an inlet that receives the cooling water and an outlet that discharges the cooling water to the internal combustion engine, wherein the inlet and the outlet both extend parallel to the first pump input shaft.

18. A marine vessel comprising:

a stern drive arrangement that is disposed in the marine vessel adjacent a vessel surface, wherein the stern drive arrangement comprises:

an internal combustion engine that extends in a longitudinal direction, a horizontal direction that is perpendicular to the longitudinal direction, and a vertical direction that is perpendicular to the longitudinal direction and perpendicular to the horizontal direction;

an engine output shaft that extends in the longitudinal direction and is driven to rotate by the internal combustion engine; and a cooling water sea pump that is powered by rotation of the engine output shaft to pump cooling water to the internal combustion engine, wherein the cooling water sea pump is positioned adjacent the vessel surface in the horizontal direction and comprises a first pump input shaft that extends parallel to the engine output shaft, a second pump input shaft that extends transversely to the first pump input shaft and is driven to rotate by the first pump input shaft, and an impeller that is driven to rotate by the second pump input shaft to pump the cooling water to the internal combustion engine, a pump housing that houses the first pump input shaft, second pump input shaft, and impeller, an access door on the pump housing that is accessible in the vertical direction.

19. The marine vessel according to claim 18, wherein the access door is removably attached to the pump housing by a plurality of removable fasteners that extend an angle to the horizontal direction and at an angle to the longitudinal direction so that the fasteners are accessible in the vertical direction.

20. The marine vessel according to claim 19, wherein the cooling water sea pump is spaced apart from the engine output shaft and is affixed to the internal combustion engine; and further wherein the access door comprises a plate that faces upwardly in the vertical direction and outwardly away from the internal combustion engine in the horizontal direction.

* * * * *